United States Patent [19]

Bruckner

[11] Patent Number: 4,853,292

[45] Date of Patent: Aug. 1, 1989

[54] STACKED LAMINATION MAGNETIC CORES

[75] Inventor: Christopher A. Bruckner, Madison, N.J.

[73] Assignee: Allied-Signal Inc., Morris Township, Morris County, N.J.

[21] Appl. No.: 185,754

[22] Filed: Apr. 25, 1988

[51] Int. Cl.[4] ..... H01F 27/24

[52] U.S. Cl. ..... 428/600; 428/928; 148/304; 336/234

[58] Field of Search ..... 336/234, 217, 210; 148/304, 305; 428/611, 928, 636, 637, 600, 638

[56] References Cited

U.S. PATENT DOCUMENTS

| | | | |
|---|---|---|---|
| 2,561,462 | 7/1951 | Compton et al. | 336/234 |
| 2,584,564 | 2/1952 | Ellis | 336/234 |
| 3,303,449 | 2/1967 | Stimler | 336/234 |
| 4,053,332 | 10/1977 | Egami et al. | 148/304 |
| 4,368,447 | 1/1983 | Inomata et al. | 148/304 |
| 4,506,248 | 3/1985 | Lin | 336/234 |
| 4,529,457 | 7/1985 | Kushnick | 148/304 |
| 4,529,458 | 7/1985 | Kushnick et al. | 148/304 |
| 4,565,746 | 1/1986 | Hayase | 336/234 |
| 4,621,248 | 11/1986 | Shigeta et al. | 336/234 |
| 4,668,931 | 5/1987 | Boenitz | 336/217 |

FOREIGN PATENT DOCUMENTS

| | | | |
|---|---|---|---|
| 1231345 | 12/1966 | Fed. Rep. of Germany | 336/217 |
| 52-43938 | 6/1977 | Japan | 336/234 |
| 57-207311 | 12/1982 | Japan | 336/217 |
| 61-295612 | 12/1986 | Japan | 336/234 |

*Primary Examiner*—John J. Zimmerman
*Attorney, Agent, or Firm*—Gus T. Hampilos

[57] ABSTRACT

A magnetic core is disclosed comprising a plurality of stacked laminations of metallic glassy ribbon. The laminations are arranged in groups of at least two laminations, with the laminations of each group being arranged to compensate for cross-sectional non-uniformity present in laminations comprising each group, thereby producing groups having substantially parallel top and bottom planar surfaces. The groups are then stacked in partially overlapping relationship to define a closed loop magnetic core. Cores formed from such groups of laminations exhibit reduced core losses as compared to prior art stacked cores.

10 Claims, 5 Drawing Sheets

STACKED LAMINATION MAGNETIC CORES

BACKGROUND OF THE INVENTION

Ferromagnetic metallic glasses have received much attention in recent years because of their exceptional magnetic properties which make them particularly suitable for use in the production of magnetic cores, especially cores for distribution transformers. However, the shape of metallic glasses products that can be produced in quantity by casting directly from the melt remains limited to thin ribbons (less than about 0.1 mm thick). Accordingly, magnetic cores produced from metallic glasses are primarily formed by winding continuous thin ribbon to form a spiral core.

Magnetic cores are, however, also produced from stacked layers of ferromagnetic material. Presently, cores for distribution transformer application are produced from silicon steel plates usually about 0.007–0.014 in (0.18–0.36 mm) thick. Unfortunately, mechanical stacking of layers of ferromagnetic materials is time consuming. Also, and more importantly, a substantial reduction in the magnetic properties of stacked cores as compared to continuous ribbon-wound cores can result due to the presence of joints in stacked cores. Non-uniform thickness of stacked layers can also increase stresses at the joints, thereby deteriorating magnetic performance. These drawbacks are even more pronounced in cores produced by stacking individual metallic glass ribbons because of the larger number of layers of metallic glass ribbon, as compared to silicon steel plates, needed to produce a stacked core of size suitable, for example, for use as a distribution transformer core.

Stacked magnetic cores are usually formed by arranging plates of ferromagnetic material in partially overlapping relationship to produce a closed loop corelet. A plurality of layers of such closed loops are arranged on top of one another to produce the stacked core. The stack is then placed under compression by clamping the layers to ensure dimensional stability and in an attempt to produce essentially no air gap between adjacent layers. The goal, of course, is to produce a dimensionally stable magnetic core have a packing factor approaching one (i.e., the actual density of the compacted product approaches the theoretical density of a single piece structure of the same material and dimensions).

Recently, the more pronounced problems associated with stacking single layers of metallic glass ribbon have largely been overcome as a result of the process disclosed in U.S. Pat. No. 4,529,457 and U.S. Pat. No. 4,529,458. According to the disclosure therein, a compact laminated structure composed of a plurality of layers of amorphous metallic ribbon is formed by holding a stack of ribbons at a pressure of at least 1,000 psi (6895 kPa) at a temperature between about 70 and 90% of the crystallization temperatures of the ribbons for a time sufficient to bond the ribbons. As a result, laminated product produced by this process overcome the time consuming task of stacking individual ribbons and reduce the problem associated with air gaps between successive layers.

Unfortunately, the use of amorphous metallic laminates as plates in the manufacture of stacked magnetic cores presents an additional significant problem. The laminates available today are generally of non-uniform shape because of slight variations in the dimensions of the strips employed to make the laminate. As a result of this non-uniformity, bending stresses are induced in the laminates when compressed to stabilize the core dimensions and to eliminate air gaps between stacked laminates. Bending stresses degrade the magnetic properties of ferromagnetic glassy ribbons used in transformer core manufacturing, particularly core loss properties, and yield magnetic cores with higher losses.

Accordingly, there remains a need in the art to produce stacked magnetic cores from metallic glass laminates without inducing unacceptably high bending stresses in the laminates.

SUMMARY OF THE INVENTION

The present invention is directed to magnetic cores comprising a plurality of elongated laminations, each of said laminations consisting essentially of a plurality of substantially amorphous ferromagnetic strips, said laminations being arranged in a plurality of groups each of which comprises at least two laminations, with a major surface of each lamination of each group being substantially co-extensive with a major surface of an adjacent lamination of said group, at least two laminations of each group having non-uniform cross-sections (each taken in a plane normal to the direction of elongation of the lamination), wherein said laminations of each group are arranged such that surfaces of said laminations defining top and bottom surfaces of the corresponding group are, on cross-section taken in a plane normal to the direciton of elongation of said laminations, substantially parallel, said groups being arranged in partially overlapping relationship to define a closed loop. The cores are particularly suited for use as power distribution transformer cores.

DETAILED DESCRIPTION OF THE INVENTION

The present invention is directed to a magnetic core which comprises a plurality of stacked laminations of metallic glassy ribbon. The laminations are arranged in groups of at least two laminations, with the laminations of each group being arranged to compensate for cross-sectional non-uniformity present in at least some of the laminations comprising each group, thereby producing groups having substantially parallel top and bottom planar surfaces. The groups are then stacked in partially overlapping relationship to define a closed loop magnetic core. Cores formed from such groups of laminations exhibit reduced core losses as compared to prior art stacked cores.

Ribbons of metallic glass are cast, most preferably, by the process described in U.S. Pat. No. 4,142,571. In general, the ribbons produced by the process have a thickness not greater than about 0.1 mm, and ordinarily are about 0.08 mm thick. The width of the strip is variable depending upon the desired width for particular application, and usually ranges from about 1 cm to about 30 cm. Compositions of typical ferromagnetic alloys which are used to produce glassy (amorphous) ribbon for the present invention are disclosed, for example, in U.S. Pat. No. 4,289,409 and European Patent Application No. 81107559.7.

According to the present invention, a plurality of ribbons are layed up one on top of another to produce a multilayered preform which is subjected to processing in accordance with the procedure described in U.S. Pat. No. 4,529,457 to produce a compact laminated product. The laminations may be produced from a ribbon pre-cut to the desired length. Alternatively, laminations of the desired length may be cut from laminated product produced from continuous ribbon.

Laminations employed in the present invention can be made up of any number of individual layers depending upon the final thickness of the lamination. Generally, laminations are produced from between about 4 and about 12 ribbons, and usually are produced from six ribbons. Ordinarily, laminations have an average thickness or between about 0.1 mm and about 0.25 mm, and usually are about 0.13 mm thick. The length and width of the laminations vary depending upon such factors as the carrying capacity of the core, core configuration, etc.

Figure 1:
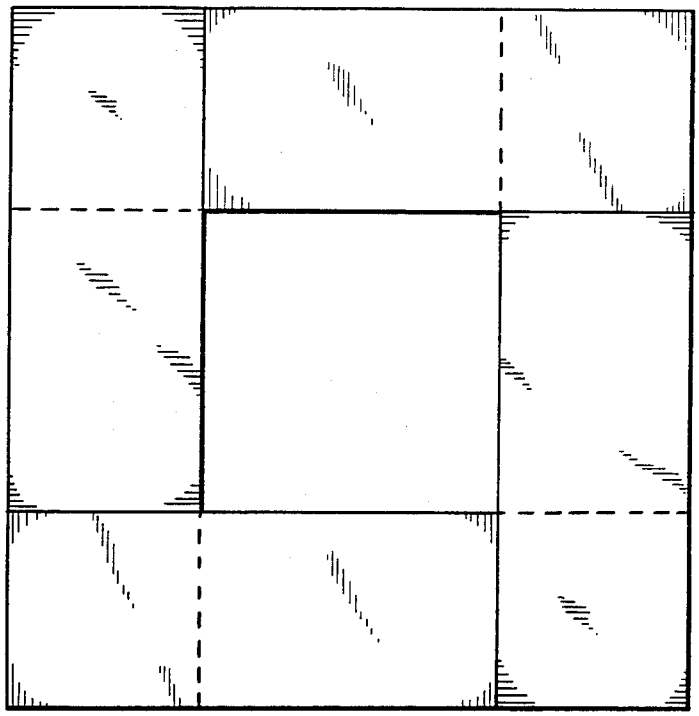
FIG. 1 is a top view of a basic core construction for a single phase core.
Figure 2:
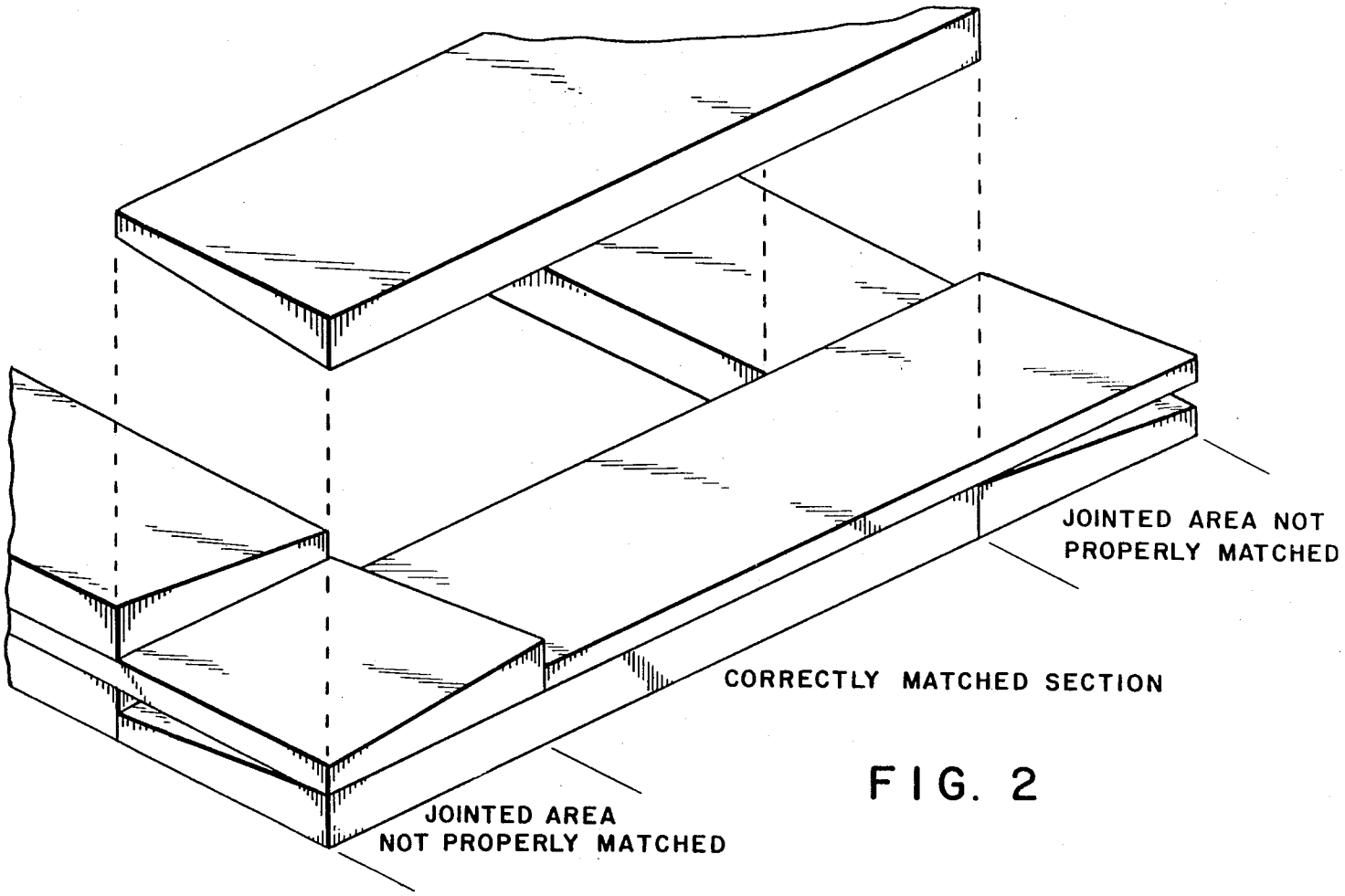
FIG. 2 illustrates a core construction for a stacked transformer core employing one aspect of the present invention.
Figure 3:
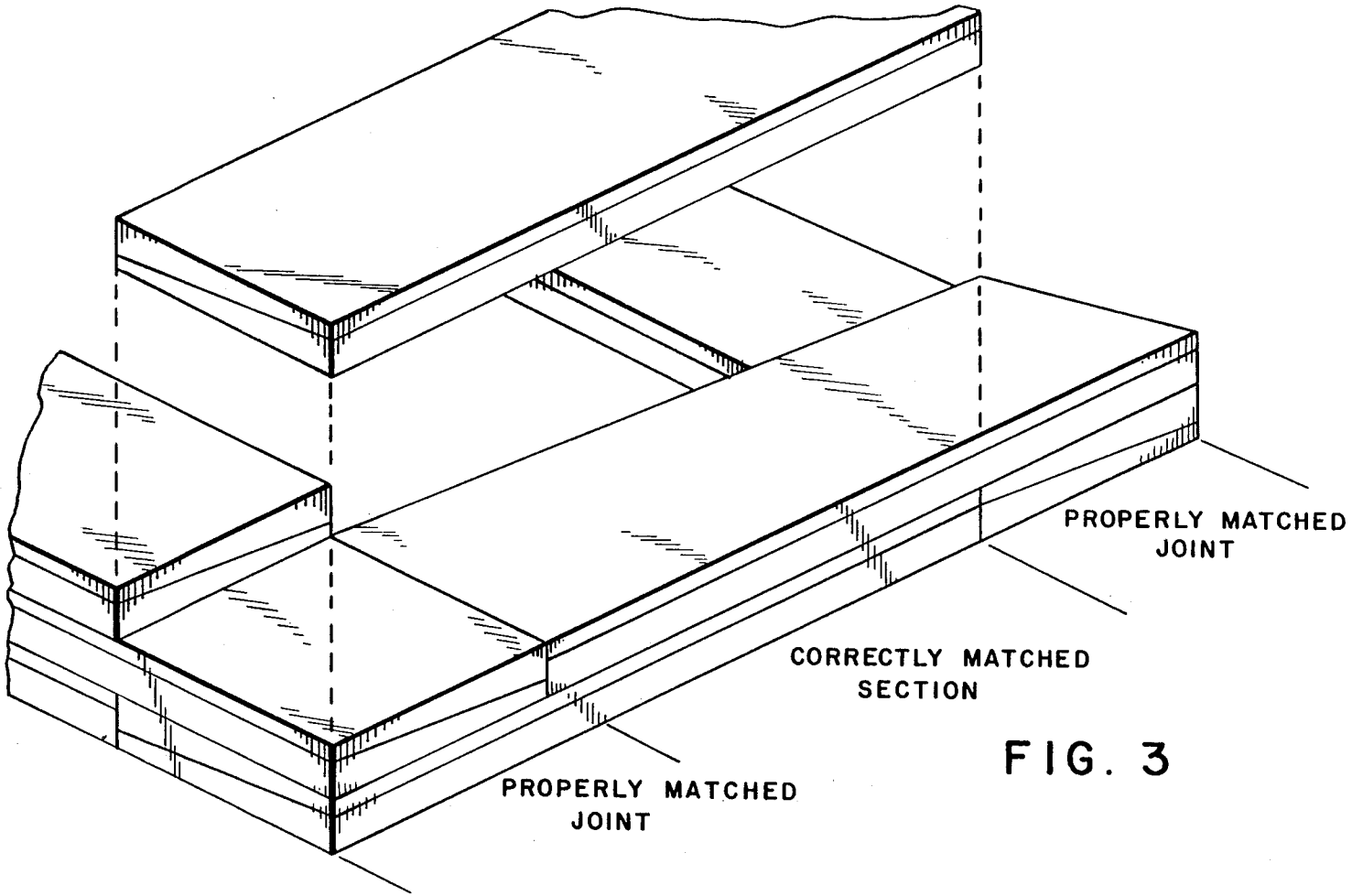
FIG. 3 illustrates construction of a stacked transformer core in accordance with both aspects of the present invention, employing two laminations per group.

As mentioned above, the laminated does not ordinarily exhibit uniform thickness across the width thereof. This non-uniformity usually results from the slight variations and thickness which occur during the production of the basic strip. As a result of such strip variations, the laminations usually exhibit a generally trapezoidal cross-section. Although the variation and thickness across the width of the lamination is generally quite small (usually less than about 20% across the width, and ordinarily about 10%), I have discovered that this variation can cause dramatic effects in core losses produced from cores stacked from these laminates, as explained below. As described heretofore, the laminates are stacked to produce a closed loop configuration. FIGS. 1 is a top view of a butt-lap joint construction for a single phase core. Side views of this type construction are illustrated in FIGS. 2 and 3. It is readily apparent to those skilled in the art the laminations may have mitered edges, with the groups arranged in partially overlapping relationship. Also, it is readily apparent to those skilled in the art that either construction is useful in the production of three phase cores, where two closed loops are defined, in part, by a common group. The stacked laminates are ordinarily mounted between top and bottom mounting plates and clamped therebetween to maintain dimentional integrity of the stacked core. Clamping is ordinarily accomplished by threaded bolts extending through the mounting plates. The stacked cores are held by the mounting plates under compression. In addition to maintaining dimensional integrity, compression is employed to substantially eliminate any air gaps which may be present between the laminations. Ordinarily the stacked cores are maintained under pressure ranging up to about 15 psi.

There are two aspects to the present invention. The first is the feature of compensating for non-uniformity of the lamination core section by arranging the laminations of each group such that top and bottom surfaces of each group are substantially parallel, planar surfaces. This aspect of the invention is illustrated in FIG. 2. The second is the discovery that undesirable bending stresses are induced into cores constructed as illustrated in FIG. 2. These stresses are induced at the overlapping joints between the laminations because of gaps created from unmatched surfaces of each lamination. I have discovered that it is critical to arrange the laminations of each group such that the top and bottom surfaces are substantially coextensive. This construction is illustrated in FIG. 3. As a result, bending stresses at the joint are substantially reduced.

Although the invention is conceptually simple, the art has heretofore failed to appreciate how bending stresses are induced into the cores and how such stresses can be overcome. Now, not only can cores with improved core losses be produced, but also stacking time can be dramatically reduced, creating substantial savings in labor costs.

In accordance with the present invention, the laminations are arranged in groups of at least two. In each group, the lamination are stacked one on top of the other in essentially complete overlapping relationship as shown in FIG. 3. Also, the laminations are arranged to produce top and bottom surfaces of each group which are substantially parallel. In FIG. 3, the laminations are illustrated as having a generally trapezoidal cross-section and are arranged such that the thin end of the trapezoid of one lamination is adjacent to the thick end of the trapezoid of the next lamination. Usually, the groups will consist of an even number of laminations because the laminations are ordinarily non-uniform. However, it is not outside the scope of the invention to have an odd number of laminations (3, 5, 7, 9, etc.) in each group, where an odd number of laminations less than the total number of laminations per group in each group have a substantially uniform cross-section.

According to the present invention, the total number of laminations in each group will ordinarily not exceed 16 because of the increase in core losses achieved. However, it should be appreciated that one might trade off higher core losses for reduced construction times. Therefore, it may be desirable under some circumstances to employ more than 16 laminations per group. Preferably, an even number of laminations of from 2 to 8 will be employed. Most preferably, 2, 4 or 6 laminations per group will be used because of the exceptionally low losses achieved.

In order to illustrate the present invention, tests were conducted on core constructions of two basic types. The first employs only one aspect of the present invention; compensating for non-uniformity of laminate cross-section during stacking. The second employs both aspects of the present invention: compensating for uniformity of laminate cross-section and substantially reducing bending stresses at the joints. The tests clearly illustrate the need for both aspects of the present invention in producing high quality magnetic cores, and obviously also indirectly illustrate the dramatic cost savings associated with cores constructed in accordance with the invention.

EXAMPLE

Single phase 16 in ×16 in (400 mm×400 mm) cores with an 8 in ×8 in (200 mm×200 mm) window were built with 4 in (101) mm wide by 12 in (305 mm) long laminations. The cores were constructed using butt-lap joints and were stacked to a height of 0.5 in (13 mm). Since the laminations are approximately 5 mils (0.13 mm) thick, approximately 400 laminations were needed to build each core to the desired height. The same laminations were used in the construction of all the cores. This was done to substantially eliminate any performance differences that may have occurred by using different lots of laminations. The cores were assembled on a jig which prevented movement of the laminations. The jig consists of two 0.375 in (9.5 mm) thick Lexan sheets (General Electric Co.).

Care was taken to ensure that laminations were properly butted up against the adjoining laminations to minimize air gaps.

Six different combinations of groupings were built and tested. The six groupings tested were: 1 (the control), 2, 4, 6, 8 and 16 laminations per group. The control core was constructed by placing one lamination into position at a time. Once the first layer was laid into position, the laminations were slid together in order to close up any gaps at the joints. Succeeding layers were stacked in the same manner. FIG. 2 illustrates the control core construction, and FIG. 3 illustrates the core construction of selected embodiments of the present invention As described heretofore, laminations have thickness variations across their width. During the stacking, the laminations were oriented to obtain even flatness during build up by alternating laminations back and forth. FIGS. 2 and 3 illustrate this feature. An additional feature of the present invention discussed above, the feature of essentially complete contact between major faces of successive laminations in each group, is specifically illustrated in FIG. 3. Once the cores had been completely stacked and the weight taken (approx. 25 lbs., 11.5 kg), primary and secondary windings were would onto each core. Sixty primary turns were would using a #10 gauge stranded cable. A 0.1 Ω resistor was used for measuring exciting current. The primary turns were evenly distributed on each of the four sides of each core. The secondary turns, used for measuring the flux level, were wound on the center of one leg. Core loss and exciting power were measured at 50 and 60 Hz at 1.3 T. The effects of compression were tested by measuring at 0.21, 35, 69, and 103 kPa (0, 3, 5, 10, 15 psi, respectively). The compression load was uniformly distributed over the top and bottom surfaces of each core. After measuring under compression, the pressure test was repeated to ensure than compression forces did not affect the core. Essentially, no changes were seen in the initial and final pressure measurements.

Table 1 gives the magnetic properties (core loss) of the cores at 60 Hz, 1.3 Tesla and 0.8 Tesla.

TABLE 1

| CORE LOSS at 60 Hz. (W/lb) | | | | | | |
|---|---|---|---|---|---|---|
| Pressure | Control | | Group of 2 | | Group of 4 | |
| psi | 1.3T | 0.8T | 1.3T | 0.8T | 1.3T | 0.8T |
| 0 | .122 | .048 | .125 | .049 | .133 | .053 |
| 3 | .138 | .054 | .141 | .054 | .147 | .057 |
| 5 | .146 | .056 | .146 | .055 | .158 | .060 |
| 10 | .153 | .060 | .152 | .059 | .164 | .064 |

TABLE 1-continued

| CORE LOSS at 60 Hz. (W/lb) | | | | | | |
|---|---|---|---|---|---|---|
| 15 | .175 | .069 | .161 | .063 | .177 | .069 |
| Group of 6 | | Group of 8 | | Group of 16 | | |
| 1.3T | 0.8T | 1.3T | 0.8T | 1.3T | 0.8T | |
| .154 | .060 | .172 | .068 | .319 | .113 | |
| .161 | .063 | .180 | .072 | .340 | .118 | |
| .165 | .065 | .182 | .074 | .342 | .119 | |
| .176 | .068 | .191 | .076 | .347 | .122 | |
| .175 | .071 | .196 | .079 | .381 | .135 | |

Table 2 presents the magnetic properties at 50 Hz, 1.3 and 0.8 Tesla.

TABLE 2

| CORE LOSS at 50 Hz. (W/kg) | | | | | | |
|---|---|---|---|---|---|---|
| Pressure | Control | | Group of 2 | | Group of 4 | |
| kPa | 1.3T | 0.8T | 1.3T | 0.8T | 1.3T | 0.8T |
| 0 | .211 | .085 | .219 | .086 | .237 | .092 |
| 21 | .241 | .093 | .245 | .094 | .262 | .099 |
| 35 | .253 | .097 | .250 | .097 | .273 | .104 |
| 69 | .264 | .103 | .268 | .103 | .284 | .110 |
| 103 | .304 | .118 | .278 | .109 | .300 | .119 |
| Group of 6 | | Group of 8 | | Group of 16 | | |
| 1.3T | 0.8T | 1.3T | 0.8T | 1.3T | 0.8T | |
| .266 | .103 | .293 | .116 | .554 | .192 | |
| .284 | .109 | .307 | .123 | .565 | .199 | |
| .286 | .113 | .317 | .125 | .580 | .202 | |
| .300 | .118 | .325 | .130 | .589 | .208 | |
| .304 | .123 | .333 | .135 | .642 | .227 | |

Figure 4:
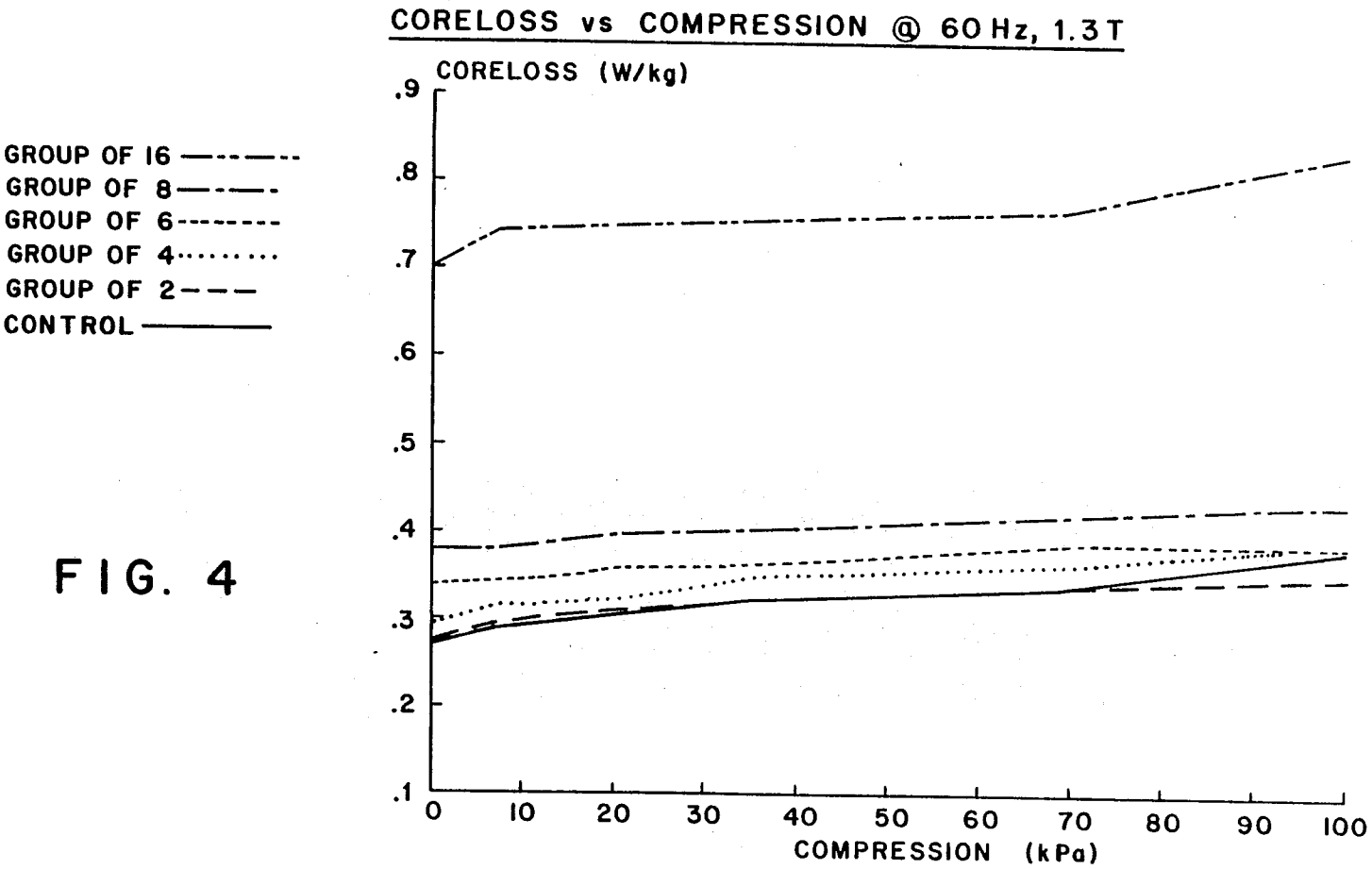
FIG. 4 is a graph of core loss vs. compression at 60 Hz and 1.3 Testa for a stacked core of the construction illustrated in FIG. 2 and stacked cores of the present invention.
Figure 5:
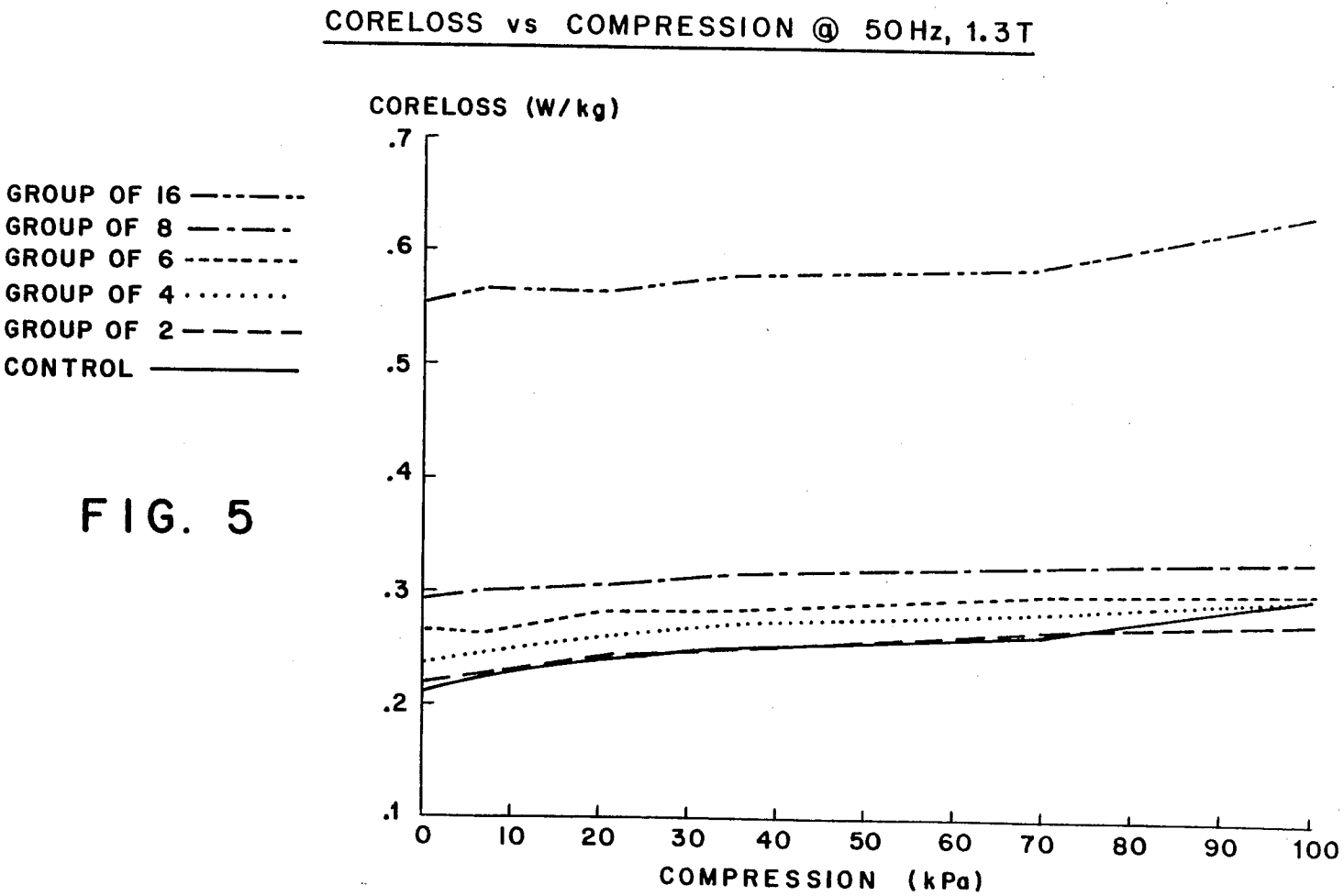
FIG. 5 is a graph of core loss vs. compression at 50 Hz and 1.3 Tesla for a stacked core of the construction illustrated in FIG. 2 and stacked cores of the present invention.

The lower induction data in each table verifies the trends seen at higher induction. FIGS. 4 and 5 graphically represent the data presented in the tables (W/kg vs. kPa). Under no load conditions, the control core (single laminations stacked on one another as shown in FIG. 2) exhibited the lowest loss. However, as the cores were placed under compression, core losses begin to increase dramatically in the control core under compression conditions usually employed in distribution transformer core environments. In fact, at 15 psi (≈103 kPa) of compression, the core loss increased to 0.175 W.lb at 60 Hz 1.3 Tesla (0.304 W/kg at 50 Hz, 1.3 Tesla), which was greater than or equal to the core losses exhibited when the laminations were stacked in groups of 2, 4 and 6. Quite unexpectedly, the core stacked in groupings of 2 achieved the lowest loss.

The control core was expected to produce the lowest losses, whether under compression or not. However, under compression, it was subjected to bending stresses at the joints which increased the core loss. Although the laminations were stacked to minimize any effect of non-flat laminations, the joint areas in the control core cannot be properly matched. FIG. 2 illustrates the problems associated with stacking laminations without appreciation of the bending stresses created at the joints from non-planar stacking.

Employing the construction illustrated in FIG. 3, cores constructed in groups of 2 are not subjected to the same degree of bending stresses as that exhibit by the control core because the groups are assembled to minimize flatness variations. In fact, as discussed above, the cores with groupings of 2, 4 and 6 achieved core losses equal to or less than that of the control core. All in all, cores with groupings of 16 or less had acceptable core losses as compared to state of the art silicon steel cores.

Having described the invention in clear, concise and exact terminology is as to enable one skilled in the art to make and use the same, the full scope of the invention is defined by the appended claims.

I claim:

1. A magnetic core comprising a plurality of elongated laminations, each of said laminations consisting essentially of a plurality of substantially amorphous ferromagnetic strips, said laminations being arranged in a plurality of groups each of which comprises at least two laminations, with a major surface of each lamination of each group being substantially co-extensive with a major surface of an adjacent lamination of said group, at least two laminations of each group having non-uniform cross-sections (each taken in a plain normal to the direction of elongation of the lamination), wherein said laminations of each group are arranged such that surfaces of said laminations defining top and bottom surfaces of the corresponding group are, on cross-section taken in a plain normal to the direction to elongation of said laminations, substantially parallel, said groups being arranged in partially overlapping relationship to define a closed loop.

2. The magnetic core of claim 1 wherein a first pair of partially overlapping groups cooperates with a second pair of partially overlapping groups to define a butt lap joint.

3. The magnetic core of claim 1 wherein the cross-section of said at least two laminations of each group is generally trapezoidal.

4. The magnetic core of claim 3 wherein each group consists of from one to eight pairs of laminations and wherein one of two non-parallel surfaces of one lamination of each pair contacts one of two non-parallel surfaces of the other lamination of the pair.

5. The magnetic core of claim 1 wherein each lamination is substantially rectangular in a plane parallel to the top surface of a group.

6. The magnetic core of claim 1 wherein each lamination is substantially trapezoidal in a plane parallel to the top surface of a group.

7. The magnetic core of claim 4 wherein each group consists of two laminations.

8. The magnetic core of claim 1 wherein each group consists of two laminations.

9. An electrical device comprising a magnetic core comprising a plurality of substantially amorphous ferromagnetic strips, said laminations being arranged in a plurality of groups each of which comprises at least two laminations, with a major surface of each lamination of each group being substantially co-extensive with a major surface of an adjacent lamination of said group, at least two laminations of each group having non-uniform cross-sections (each taken in a plain normal to the direction of elongation of the lamination), wherein said laminations of each group are arranged such that surfaces of said laminations defining top and bottom surfaces of the corresponding group are, on cross-section taken in a plain normal to the direction to elongation of said laminations, substantially parallel, said groups being arranged in partially overlapping relationship to define a closed loop.

10. A transformer core comprising a plurality of substantially amorphous ferromagnetic strips, said laminations being arranged in a plurality of groups each of which comprises at least two laminations, with a major surface of each lamination of each group being substantially co-extensive with a major surface of an adjacent lamination of said group, at least two laminations of each group having non-uniform cross-sections (each taken in a plain normal to the direction of elongation of the lamination), wherein said laminations of each group are arranged such that surfaces of said laminations defining top and bottom surfaces of the corresponding group are, on cross-section taken in a plain normal to the direction to elongation of said laminations, substantially parallel, said groups being arranged in partically overlapping relationship to define a closed loop.

* * * * *

UNITED STATES PATENT AND TRADEMARK OFFICE

CERTIFICATE OF CORRECTION

PATENT NO. : 4,853,292

DATED : August 1, 1989

INVENTOR(S) : Christopher A. Bruckner

It is certified that error appears in the above-identified patent and that said Letters Patent is hereby corrected as shown below:

Column 8, line 39 --partically-- should read "partially"

Signed and Sealed this

Fifth Day of June, 1990

*Attest:*

HARRY F. MANBECK, JR.

*Attesting Officer*

*Commissioner of Patents and Trademarks*